US006447622B1

(12) United States Patent
Yamada et al.

(10) Patent No.: US 6,447,622 B1
(45) Date of Patent: Sep. 10, 2002

(54) HIGH CARBON STEEL WIRE EXCELLENT IN WIRE-DRAWABILITY AND IN FATIGUE RESISTANCE AFTER WIRE DRAWING

(75) Inventors: Wataru Yamada; Seiki Nishida; Satoshi Sugimaru, all of Kimitsu; Naoshi Hikita, Chiyoda-ku; Hiromi Takahashi, Kimitsu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/763,046

(22) PCT Filed: Jun. 16, 2000

(86) PCT No.: PCT/JP00/03977

§ 371 (c)(1),
(2), (4) Date: Feb. 15, 2001

(87) PCT Pub. No.: WO00/77271

PCT Pub. Date: Dec. 21, 2000

(30) Foreign Application Priority Data

Jun. 16, 1999 (JP) ..... 11-169469

(51) Int. Cl.[7] ..... C22C 38/02; C22C 38/04; C22C 38/08; C22C 38/18

(52) U.S. Cl. ..... 148/320; 148/333; 148/334; 148/335; 148/336

(58) Field of Search ..... 148/320, 333–336, 148/595

(56) References Cited

U.S. PATENT DOCUMENTS 6,277,220 B1 * 8/2001 Hamada et al. ..... 148/320

FOREIGN PATENT DOCUMENTS

| | | |
|---|---|---|
| JP | 50-71507 | 6/1975 |
| JP | 50-81907 | 7/1975 |
| JP | 55-24961 | 2/1980 |
| JP | 57-22969 | 5/1982 |
| JP | 57-35243 | 7/1982 |
| JP | 62-130258 | 6/1987 |
| JP | 62-290848 | 12/1987 |
| JP | 63-192846 | 8/1988 |
| JP | 2-107746 | 4/1990 |
| JP | 03-061322 | 3/1991 |
| JP | 4-8499 | 2/1992 |
| JP | 6-74484 | 9/1994 |
| JP | 6-74485 | 9/1994 |
| JP | 06-306542 | 11/1994 |

* cited by examiner

*Primary Examiner*—Deborah Yee
(74) *Attorney, Agent, or Firm*—Kenyon & Kenyon

(57) ABSTRACT

The present invention provides a high carbon steel wire remarkably excellent in wire-drawability and fatigue resistance after wire drawing with a low cost due to reduced use of costly alloys. A high carbon steel wire according to the present invention is one excellent in wire-drawability and fatigue resistance after wire drawing, characterized in that; the total oxygen content is 15 to 50 ppm; among non-metallic inclusions included therein, the number of inviscid inclusions is 1.5 pieces/mm$^2$ or less in average under the visual field of an optical microscope; among the inviscid inclusions, the number of those having a composition falling within composition A specified below accounts for more than 20% and the total number of those having a composition falling within composition A or B specified below accounts for 80% or more; and the thickness of the inviscid inclusions having a composition falling within composition A specified below is 40 $\mu$m or less; composition A: containing over 70% of $SiO_2$, composition B: containing 25 to 70% of $SiO_2$, 8 to 30% of MnO, 40% or less of MgO, 35% or less of $Al_2O_3$, 25% or less of CaO and 6% or less of $TiO_2$, and at least 5% of one or both of $Al_2O_3$ and MgO, and additionally at least 2% of one or both of CaO and $TiO_2$.

5 Claims, No Drawings

HIGH CARBON STEEL WIRE EXCELLENT IN WIRE-DRAWABILITY AND IN FATIGUE RESISTANCE AFTER WIRE DRAWING

FIELD OF ART

The present invention relates to a high carbon steel wire for wire drawing excellent in wire-drawability and in fatigue resistance after wire drawing, which steel wire is used for, for example, bridge cables, various wires for aircraft, long rubber belts, cords for steel tires, etc., after wire drawing.

BACKGROUND ART

High carbon steel wire for wire drawing is generally required to withstand high-speed drawing and to have excellent fatigue resistance after wire drawing. Hard oxide type non-metallic inclusions are one:of the factors adversely affecting these properties.

Among oxide type inclusions, inclusions of a single composition such as $Al_2O_3$, $SiO_2$, CaO, $TiO_2$ and MgO, etc. are generally hard and inviscid. It is widely known, therefore, that it is necessary to enhance the cleanliness of molten steel and soften oxide type inclusions to manufacture a high carbon steel wire having excellent wire-drawability.

As methods to enhance the cleanliness of steel and soften inviscid inclusions, Japanese Examined Patent Publication No. S57-22969 discloses a method to manufacture a high carbon steel excellent in wire-drawability, and Japanese Unexamined Patent Publication No. S55-24961 discloses a method to manufacture an ultrafine wire. The basic concept of these technologies, however, is limited to the composition control of oxide type non-metallic inclusions in the ternary compound system of $Al_2O_3$-$SiO_2$-MnO.

Meanwhile, Japanese Unexamined Patent Publication No. S50-71507 proposes to improve wire-drawability of a product by having the composition of non-metallic inclusions fall within the range of spessartite in the ternary compound system phase diagram of $Al_2O_3$, $SiO_2$ and MnO, and Japanese Unexamined Patent Publication No. S50-81907 discloses a method to improve wire-drawability by decreasing harmful inclusions through the control of the Al amount added to molten steel.

Additionally, Japanese Examined Patent Publication No. S57-35243 proposes, in relation to manufacturing steel cords for tires with an inviscid inclusion index of 20 or below, to soften inclusions by injecting alloys containing one or more of Ca, Mg and REM after preliminary deoxidation by injecting a flux containing CaO with a carrier gas (inert gas) into molten steel in a ladle with the complete control of Al.

In above proposed methods, in case of reforming ternary system non-metallic inclusions, stable composition control is not easy while, in case of controlling multi-component non-metallic inclusions, the reduction of the size and number of inclusions and the security of ductility are hard to achieve and, thus, an improvement in wire-drawability and fatigue resistance after wire drawing cannot be expected. In Japanese Examined Patent Publication No. H4-8499, a high carbon steel wire having remarkably excellent wire-drawability and fatigue resistance after wire drawing has been realized by; specifying the total oxygen content within a prescribed range and controlling the amount and composition of inviscid inclusions; obtaining favorable distribution of the amount and size of inviscid inclusions by securing the reduction of the size and number of inviscid inclusions and their ductility; and softening inclusions by reforming the composition of inclusions into oxide type inclusions of multi-component system containing $SiO_2$ and MnO and selectively containing $Al_2O_3$, MgO, CaO and $TiO_2$.

In the invention disclosed in Japanese Examined Patent Publication No. H4-8499, a secondary deoxidizer containing Al and two or more of Mg, Ca, Ba, Ti, V, Zr and Na is added to molten steel, for the purpose of reforming inclusions into oxide type inclusions of multi-component system containing $SiO_2$ and MnO and selectively containing $Al_2O_3$, MgO, CaO and $TiO_2$. However, these alloys for deoxidation are expensive and thus it is desirable, for the reduction of production cost, to reduce the use of these costly alloys.

DISCLOSURE OF THE INVENTION

The object of the present invention is to provide a high carbon steel wire remarkably excellent in wire-drawability and fatigue resistance after wire drawing at a low cost by reducing the use of the above-mentioned expensive alloys.

Namely, the gist of the present invention is as follows:

(1) A high carbon steel wire excellent in wire-drawability and fatigue resistance after wire drawing, characterized in that; the total oxygen content is 15 to 50 ppm; among non-metallic inclusions included therein, the number of inviscid inclusions is 1.5 pieces/$mm^2$ or less in average under the visual field of an optical microscope; among the inviscid inclusions, the number of those having a composition falling within composition A specified below accounts for more than 20% and the total number of those having a composition falling within composition A or B specified below accounts for 80% or more; and the thickness of the inviscid inclusions having a composition falling within composition A specified below is 40 $\mu$m or less;

composition A: containing over 70% of $SiO_2$, composition B: containing 25 to 70% of $SiO_2$, 8 to 30% of MnO, 40% or less of MgO, 35% or less of $Al_2O_3$, 25% or less of CaO and 6% or less of $TiO_2$, and at least 5% of one or both of $Al_2O_3$ and MgO and, additionally, at least 2% of one or both of CaO and $TiO_2$.

(2) A high carbon steel wire excellent in wire-drawability and fatigue resistance after wire drawing according to item (1), characterized in that the inclusions having composition B specified above contain 5% or less of other oxides (one or more of the oxides of V, Ba, Zr and Na and trace amount of other oxides inevitably included, hereunder referred to as "other oxides").

(3) A high carbon steel wire excellent in wire-drawability and fatigue resistance after wire drawing according to item (1) or (2), characterized in that the number of inviscid inclusions having a composition falling within composition A is 1 piece/$mm^2$ or less in an observation visual field.

(4) A high carbon steel wire excellent in wire-drawability and fatigue resistance after wire drawing according to any one of items (1) to (3), characterized by containing 0.4 to 1.2% of C, 0.1 to 1.5% of Si and 0.1 to 1.5% of Mn in weight.

(5) A high carbon steel wire-excellent in wire-drawability and fatigue resistance after Wire drawing according to any one of items (1) to (3),:characterized. by containing, in weight, 0.4 to 1.2% of C, 0.1 to 1.5% of Si and 0.1 to 1.5% of Mn, additionally P and S controlled not to exceed 0.02%, respectively, and one or more of 0.05 to 1.0% of Cr, 0.05 to 1.0% of Ni, 0.05 to 1.0% of Cu, 0.001 to 0.01% of B. 0.001 to 0.2% of Ti, 0.001 to 0.2% of V, 0.001 to 0.2% of Nb, 0.05 to 1.0% of Mo and 0.1 to 2% of Co.

Here, inviscid inclusions denote inclusions whose length or thickness is 5 $\mu$m or more and the length (1) and the thickness (d) of each of them satisfy the formula $1/d \leqq 5$, under optical microscope observation of a longitudinal section including the center line of a wire.

It is generally known that, when inclusions contain the oxides of simple composition or specific oxides in high quantity, they are hard and their plasticity is poor. The most significant feature of the present invention is a discovery of the fact that the inclusions having a high content of $SiO_2$ are softer than those having high content of $Al_2O_3$ and MgO and that, even if inclusions having high content of said $SiO_2$ account for more than 20%, the wire-drawability and fatigue resistance after wire drawing of a steel wire are not adversely affected so long as the thickness (d) of said inclusions is controlled not to exceed 40 $\mu$m.

BEST EMBODIMENT FOR CARRYING OUT THE INVENTION

On specifying Total Oxygen Content in the Range of 15 to 50 ppm

When the total oxygen content of steel is high, blowholes are generated during the solidification of molten steel causing surface defects and the amount of inviscid inclusions increases-in a steel wire having a total oxygen content exceeding 50 ppm. For this reason, the upper limit of the total oxygen content is set at 50 ppm. On the other hand, though it is easy to reduce the total oxygen content to 15 ppm or less when a strong deoxidizer such as Al and Mg is used abundantly, a total oxygen content of 15 ppm or more is required for the composition control of inviscid inclusions in a steel wire of the present invention. A yet preferable range of the total oxygen content is from 17 to 40 ppm. Further, when the total oxygen content is below 15 ppm or more than 50 ppm, the service life of the wire drawing dies deteriorates drastically and, for this reason, the range of the total oxygen content is set at 15 to 50 ppm.

On specifying the Number of Inviscid Inclusions

The amount of inviscid inclusions among oxide type non-metallic inclusions in a steel wire affects its wire-drawability and fatigue resistance after wire drawing. From this viewpoint, for the present invention too, it is necessary to reduce the amount of inviscid inclusions to as little as possible. By controlling the number of inviscid inclusions to 1.5 pieces/$mm^2$ or less, excellent wire-drawability and fatigue resistance after wire drawing can be obtained through combined effects with the other requirements claimed herein. When the number of inviscid inclusions exceeds 1.5 pieces/$mm^2$, the wire disconnection rate rises markedly high and the die service life becomes shorter. It is preferable yet to control the number of the non-metallic inclusions to 1.0 piece/$mm^2$ or less.

On the Composition of Inviscid Inclusions

In conventional technologies, inviscid inclusions are softened by compounding the composition of the inclusions. In those technologies, the SiO2 content of inclusions is specified to be 70% or less because it is understood that hard $SiO_2$ inclusions form when $SiO_2$ concentration exceeds the percentage figure.

The present inventors have discovered, as a result of intensive studies, that, even if inviscid inclusions have a high $SiO_2$ content, they do not cause any harm even in a succeeding wire drawing process so long as their size is small. It is true that $SiO_2$ type inclusions are hard, but they are softer than MgO or $Al_2O_3$ type inclusions. Therefore, wire-drawability and fatigue resistance after wire drawing are sufficiently good so long as the size of the inclusions is controlled to $d \leqq 40$ $\mu$m. It is more preferable to control the size of inviscid inclusions having a high $SiO_2$ content to $d \leqq 20$ $\mu$m.

In the present invention, composition B denotes the composition range of inclusions which are sufficiently soft and rendered harmless by being broken down and minutely dispersing during wire drawing, while composition A denotes the composition range of inclusions having a higher $SiO_2$ content than the inclusions conforming to the composition B. It has been specified that the number of inviscid inclusions conforming to composition A accounts for 20% or more and the total number of those conforming to composition A or B accounts for 80% or more.

The reason why the total number of inclusions conforming to composition A or B must account for 80% or more is that inclusions having composition not falling within any of compositions A and B are, for example, MgO and $Al_2O_3$ type inclusions and they are hard, and that these hard inclusions deteriorate wire-drawability and fatigue resistance after wire drawing when their proportion exceeds 20%.

Further, the reason why the number of inclusions conforming to composition A must account for 20% or more is that inclusions conforming to composition A increase as the addition amount of ferroalloys of Ca, Al, Mg and Ti in molten steel is decreased, and that, when the addition amount of these ferroalloys is decreased to the extent of raising the proportion of inclusions conforming to composition A to 20% or more, the cost reduction effect, which is an object of the present invention, can be achieved.

In the present invention, the range of the composition B is defined as follows:

① containing 25 to 70% of $SiO_2$, 8 to 30% of MnO, 40% or less of MgO, 35% or less of $Al_2O_3$, 25% or less of CaO and 6% or less of $TiO_2$, and at least 5% of one or both of $Al_2O_3$ and MgO, and additionally at least 2% of one or both of CaO and $TiO_2$, ② containing 5% or less of other oxides (one or more of the oxides of V, Ba, Zr and Na and trace amount of other oxides inevitably included, hereunder referred to as "other oxides").

The reason why the range of composition B is limited will be explained hereunder.

To reduce the number of inviscid inclusions and soften them, which is an object of the present invention, the combination of oxide compositions in a multi-component system as specified above is required. One combination is oxides of a quaternary or higher compound system containing $SiO_2$ and MnO firstly and inevitably, then one or both of $Al_2O_3$ and MgO, and additionally one or both of CaO and $TiO_2$. Another combination is oxides of a quaternary or higher compound system containing 5% or less of the other oxides in addition to above oxides. Here, the addition of 5% or less of the other oxides contribute to softening the inviscid inclusions yet further. The steel according to the present invention does not fail to be a steel wire excellent in wire-drawability and fatigue resistance after wire drawing if inviscid inclusions conforming to composition B have either of the combinations according to the present invention.

When $SiO_2$ content is below 25%, a good combination with the other oxides as inclusions of multi-component system oxides cannot be obtained. The range of $SiO_2$ content of over 70% coincides with the range of composition A, which has conventionally been avoided as the one where hard inclusions are formed.

Since MnO is displaced or compounded by the oxidation with Al and Mg, 30% or more of MnO is not formed. When its content is below 8%, on the other hand, the inviscid inclusions become hard. For this reason, the range of MnO is set at 8 to 30%.

With MgO content exceeding 40%, hard MgO inclusions are formed and thus its content is limited to 40% or less. A preferable range is from 5 to 25%.

With $Al_2O_3$ content exceeding 35%, well-balanced combination of multi-component system oxides is disturbed, causing the other oxide elements in inclusions to relatively lower, resulting in the formation of hard inclusions. The upper limit of $Al_2O_3$ to avoid this problem is 35%, more preferably 25%.

With regard to the combination of $Al_2O_3$ and MgO, in the manufacture of a steel wire according to the present invention, wherein $SiO_2$ type oxides suspended in molten steel are combined with Ca, Mg and Al, etc. during a secondary deoxidation process to form compound inclusions, inviscid inclusions become soft and are rendered harmless when the total content of one or both of $Al_2O_3$ and MgO in inviscid inclusions formed in a steel wire is 5% or more. For this reason, the lower limit of one or both of $Al_2O_3$ and MgO is set at 5%.

With regard to CaO, when the CaO content is high, generally speaking, spherical inviscid inclusions are formed. However, when CaO content is 25% or less and the inclusions are of multi-component system as in the present invention, CaO also contributes to decreasing the hardness of oxide type inclusions and reducing the number of inviscid inclusions. The upper limit of CaO content is, therefore, set at 25%. A more preferable content range of CaO is from 1 to 20%.

Ti is an element generally used for the control of austenite crystal grain size. However, it is also effective for softening non-metallic inclusions of multi-component system oxides like in the present invention. It is particularly effective for softening when $TiO_2$ content is 6% or less in the inviscid inclusions of the multi-component system. Hence, the $TiO_2$ content range is set at 6% or less. A more preferable range is 4% or less.

With regard to the combination of Cad and $TiO_2$, when the content of one or both of them is 2% or more, the inviscid inclusions are softened yet further.

Lastly, the content of the other oxides limited to 5% or less is described hereunder.

The composition described above is essential for obtaining the multi-component system inviscid inclusions according to the present invention. Further, V, Ba, Zr and Na, etc. are added in addition to secondary deoxidation elements. These oxides and other oxides such as oxides of Cr and K, etc. inevitably included in steel bin very small quantities are collectively called the other oxides. When the content of the other oxides is 5% or less, they contribute to softening inviscid inclusions. For this reason, the upper limit of the combined content of one or more of the other oxides is set at 5%.

Now, combinations of the oxides described above are explained hereunder.

Firstly, the reason is given as to why $SiO_2$ and MnO are indispensable in any case.

The inviscid inclusions comprising multi-component system oxides according to the present invention can be obtained, as described in examples, by forming a deoxidation product of $SiO_2$+MnO at primary deoxidation and, thereafter, forming a compound $SiO_2$ deoxidation product at secondary deoxidation. Thus, as a matter of course, $SiO_2$ and MnO, which form the basis of the deoxidation products, must not fail to exist in inviscid inclusions.

Then, the combination of $Al_2O_3$ and MgO is described hereunder.

As one of the deoxidation technologies to form non-metallic inclusions of multi-component system oxides according to the present invention, an important technology is the utilization of strong deoxidation effects of Al and Mg and the coagulation and floating effects of said inclusions in molten steel. With regard to said inclusions remaining in molten steel after refining of molten steel, there is a relationship between $Al_2O_3$ and MgO in the same refined molten steel that, in the composition range of inviscid inclusions according to the present invention, MgO content tends to be low when $Al_2O_3$ content is high and, reciprocally, $Al_2O_3$ content tends to be low when MgO content is high. For this reason, the present invention prescribes that one or both of $Al_2O_3$ and MgO must be contained.

Next, a reason is given to explain why it is. prescribed that one or both of CaO and $TiO_2$ must be contained.

The non-metallic inclusions of multi-component system oxides like those according to the present invention show widely varied composition changes depending on deoxidation conditions. In this background, one or both of CaO and $TiO_2$ must be present in inviscid inclusions, especially in order to reduce the number of inviscid inclusions of multi-component system inclusions and soften them.

An important point of the present invention is to control the size of inviscid inclusions conforming to composition A so that $d \leqq 40\ \mu m$ holds true. This is because the inclusions conforming to composition A do not hinder the inclusion softening effect when the formula $d \leqq 40cm$ is satisfied, although they are somewhat harder than the inclusions whose composition falls within composition B.

Large inclusions whose d exceeds 40 $\mu$m are mainly ladle deoxidation products formed in molten steel in a ladle after deoxidation. When compound deoxidation involving Ca, Al, Mg and Ti is carried out so that most inviscid inclusions have compositions conforming to composition B as in the present invention, said deoxidation products in a ladle are softened, and most of the large inclusions having d exceeding 40 $\mu$m are stretched to satisfy $l/d>5$. In this case, since most of those $SiO_2$-rich inclusions conforming to composition A are those formed during steel solidification, they cannot grow large and the formula $d \leqq 40\ \mu m$ remains true. Thus, d of the inviscid inclusions whose composition falls within compositions A and B can be controlled not to exceed 40 $\mu$m.

As explained above, it is necessary in the present invention to control the number of inviscid inclusions to 1.5 pieces/$mm^2$ or less. By the present invention wherein a compound deoxidation is carried out so that the total number of inviscid inclusions conforming to composition A and those conforming to composition B is 80% or more, it is possible, as a consequence, to stably maintain the number of inviscid inclusions at 1.5 pieces/$mm^2$ or less. Preferably, by controlling the number of inviscid inclusions to 1.0 piece/$mm^2$ or less, the wire-drawability and fatigue resistance after wire drawing of a steel wire stabilize.

The present invention can secure excellent wire-drawability and fatigue resistance after wire drawing by controlling the composition, size and number of inclusions as described above. In addition, the service life of wire drawing dies can be extended by the present invention by reducing the number of inviscid inclusions conforming to composition A to 1.0 piece/$mm^2$ or less in average, and more preferably, to 0.5 piece/$mm^2$ or less.

As described above, the present invention achieves excellent results in the applications where wire-drawability and fatigue resistance after wire drawing as severe as conventional cases are required. Recently, however, larger diameter cords are used in some tire cord applications, wherein the required wire-drawability is a little more relaxed than before. With regard to the service life of wire drawing dies, also, improvements in lubrication and other factors have made it possible to continue drawing operations not affected by deterioration in inclusion levels in steel materials. The super-clean steel according to the present invention has an excellent effect especially in these applications.

The specification of the steel chemical composition according to the present invention is explained hereunder. Killed steels for piano wire rods and hard steel wire rods under the Japanese Industrial Standard (JIS) G3502 and G3506 are widely used as the steels for high carbon steel wires. On the basis of these JIS steel grades and in consideration of ease of manufacturing and actual applications, the present invention specifies steel chemical composition, in weight, as follows: said steel containing 0.4 to 1.2% of C, 0.1 to 1.5% of Si and 0.1 to 1.5% of Mn, and containing one or more of 0.05 to 1.0% of Cr, 0.05 to 1.0% of Ni, 0.05 to 1.0% of Cu, 0.001 to 0.01% of B, 0.001 to 0.2% of Ti, 0.001 to 0.2% of V, 0.001 to 0.2% of Nb, 0.05 to 1.0% of Mo and 0.1 to 2% of Co as required.

C is an economical and effective element to strengthen steel, and 0.4% or more of it is required to obtain the strength required for a hard steel wire. When its content exceeds 1.2%, however, the ductility of steel decreases, resulting in embrittlement and difficulty in secondary working. For this reason, the content is set at 1.2% or less.

Si and Mn, on the other hand, are necessary for deoxidation and the control of the composition of inclusions. Either of them is ineffective when added below 0.1%. Both the elements are also effective for strengthening steel, but steel becomes brittle when either of them exceeds 1.5%.

Cr has to be controlled within a range from 0.05 to 1.0% because the least necessary amount for securing its effect to refine pearlite lamella and enhance steel strength is 0.05% and thus the addition of Cr in the amount of 0.05% or more is desirable. However, when added beyond 1.0%, ductility deteriorates. For this reason, the upper limit is set at 1.0%.

Ni strengthens steel through an effect similar to that of Cr, hence the addition amount of 0.05% or more, where the effect is demonstrated, is desirable, but its content has to be 1.0% or less so as not to cause the deterioration of ductility.

Since Cu improves scale properties and corrosion fatigue properties of a wire, the addition amount of 0.05% or more, where the effect is demonstrated, is desirable, but its content has to be 1.0% or less so as not to cause deterioration of ductility.

B is an element to enhance hardenability of steel. In case of the present invention, it is possible to enhance steel strength by adding B, but its excessive addition deteriorates steel toughness through increased boron precipitation, and for this reason, its upper limit is set at 0.01%. Too small an addition amount of B does not bring about any effect, and hence its lower limit is set at 0.001%.

Ti, Nb and V enhance the strength of a steel wire through precipitation hardening. None of them is effective when added below 0.001%, but they cause precipitation embrittlement when added beyond 0.2%. For this reason their respective contents have to be 0.2% or less. Addition of these elements is also effective for fining γ grains during patenting.

Mo is another element to enhance steel hardenability. In case of the present invention, it is possible to enhance steel strength by adding Mo, but its excessive addition raises steel hardness excessively resulting in poor workability and, for this reason, the range of its addition amount is specified as 0.05 to 1.0%. Co enhances steel ductility by suppressing the formation of pro-eutectoid cementite of supereutectoid steel.

In addition, in high carbon steels, it is preferable to control the content of each of P and S to 0.02% or less since either of them deteriorates not merely wire-drawability but also ductility after wire drawing.

Note that the present invention can be applied not only to a steel wire but also to any hot-rolled steel product.

EXAMPLE

The refining of molten steel for the,examples was carried out using an LD converter and the slag spillage from the converter into a ladle at tapping was minimized (50 mm or less in thickness) by the use of a slag stopper ball.

A recarburizer and deoxidizing ferroalloys such as Fe—Mn, Fe—Si, and Si—Mn were added at the tapping to adjust the contents of C, Mn and Si, then argon was injected into molten steel from the bottom of a ladle.

The molten steel in the ladle after the tapping was a killed steel deoxidized with Si and Mn, etc. The ladle was then transferred to a refinery position and, then, after a slag composition adjustment process, secondary deoxidizer, in the form of ferroalloys and containing Al and two or more of Mg, Ca, Ba, Ti, V, Zr, Na and REM, was added into the molten steel. The alloy was fed into the molten steel through a bare steel surface cleared of slag by argon bottom bubbling.

At the ferroalloy addition, the total Al input amount including Al from the ferroalloys for deoxidation and other purposes was controlled to 5.0 to 9.5 g/t-molten steel. In conventional steel for comparison, Mg and Ca ferroalloys were added as appropriate.

After the addition of ferroalloy, the molten steel further underwent a fine composition adjustment before the completion of ladle refining. The molten steel was then continuously cast from the ladle via a tundish, heated in a reheating furnace, rolled into billets, surface-conditioned, then rolled into wires of 5.5 mm in diameter via another reheating furnace and a wire-rod mill.

In the examples, the number and composition of inviscid inclusions were examined in the following manner: a sample of 0.5 m long was cut out from a coil of steel wire of 5.5 mm in diameter; small specimens of 11 mm long each were cut out from 10 places chosen at random along the length of each of the samples; and the entire surface of a longitudinal section of each of the small specimens including its longitudinal center line was inspected. The number of the inviscid inclusions used in the examples is the mean value of all samples.

After that, the 5.5-mm diameter wires were drawn into fine wires of 0.175 mm or less in diameter to investigate their wire drawing properties and die service life. The wire drawing properties were evaluated by converting the frequency of wire disconnection per each prescribed wire drawing tonnage into a wire disconnection index. A wire disconnection index of 5 or less means good. The die service life was evaluated using an index wherein a minimum allowable die service life with conventional materials is 100 and the index value is larger as the service life becomes longer. A die service life index of 100 or larger means good.

Tables 1 and 2 show the examination results of the materials according to the present invention and Tables 3 and 4 those of the comparative materials. Tables 2 and 4 show the evaluation results of the non-metallic inclusions of the materials evaluated in Tables 1 and 3, respectively, classified into average composition, composition A and composition B.

TABLE 1

| | No. | Chemical composition (wt %) | | | | | | | | | | | | | |
|---|---|---|---|---|---|---|---|---|---|---|---|---|---|---|---|
| | | C | Si | Mn | P | S | Cr | Ni | Cu | B | Ti | V | Nb | Mo | Co |
| Invented materials | 1 | 0.72 | 0.18 | 0.51 | 0.018 | 0.022 | — | — | — | — | — | — | — | — | — |
| | 2 | 0.82 | 0.18 | 0.51 | 0.010 | 0.021 | — | — | — | — | — | — | — | — | — |
| | 3 | 0.92 | 0.20 | 0.30 | 0.012 | 0.019 | 0.50 | — | — | — | — | — | — | — | — |
| | 4 | 0.96 | 1.20 | 0.30 | 0.011 | 0.015 | 0.20 | — | — | — | — | — | — | — | — |
| | 5 | 0.81 | 0.19 | 0.31 | 0.015 | 0.021 | 0.24 | — | — | — | — | — | — | — | — |
| | 6 | 0.42 | 0.25 | 0.31 | 0.021 | 0.015 | — | — | — | — | — | — | — | — | — |
| | 7 | 0.72 | 0.10 | 0.11 | 0.024 | 0.018 | — | — | — | — | — | — | — | — | — |
| | 8 | 1.18 | 0.20 | 0.70 | 0.012 | 0.025 | — | — | — | — | — | — | — | — | — |
| | 9 | 0.75 | 1.50 | 0.75 | 0.013 | 0.023 | — | — | — | — | — | — | — | — | — |
| | 10 | 0.82 | 0.25 | 1.49 | 0.018 | 0.019 | — | — | — | — | — | — | — | — | — |
| | 11 | 0.62 | 0.18 | 0.49 | 0.022 | 0.024 | — | — | — | — | — | — | — | — | — |
| | 12 | 0.77 | 0.18 | 0.53 | 0.010 | 0.018 | — | — | — | — | — | — | — | — | 0.5 |
| | 13 | 0.82 | 0.18 | 0.53 | 0.015 | 0.022 | — | — | — | 0.006 | — | — | — | — | — |
| | 14 | 0.73 | 0.22 | 0.70 | 0.016 | 0.021 | 0.18 | — | 0.24 | — | — | — | — | — | — |
| | 15 | 0.83 | 0.19 | 0.50 | 0.022 | 0.018 | 0.24 | — | — | — | 0.009 | 0.008 | — | — | — |
| | 16 | 0.71 | 0.30 | 0.49 | 0.010 | 0.025 | — | — | — | — | — | 0.003 | 0.007 | — | — |
| | 17 | 0.81 | 0.22 | 0.51 | 0.009 | 0.023 | — | 0.92 | 0.22 | 0.002 | — | — | — | — | — |
| | 18 | 0.95 | 0.18 | 0.50 | 0.016 | 0.018 | — | — | — | — | — | — | 0.009 | 0.08 | — |

| | No. | ppm Total oxygen content | Number of total inclusions *1 | Number of inclusions of composition A *2 | Rate of inclusions (%) *3 | | Max. d (μm) *4 | Wire dis-connection index | Die service life index |
|---|---|---|---|---|---|---|---|---|---|
| | | | | | A | A + B | | | |
| Invented materials | 1 | 24 | 0.13 | 0.05 | 35 | 100 | 16 | 0 | 150 |
| | 2 | 22 | 0.07 | 0.02 | 28 | 98 | 17 | 0 | 190 |
| | 3 | 23 | 0.19 | 0.08 | 41 | 100 | 19 | 0 | 200 |
| | 4 | 21 | 0.05 | 0.02 | 39 | 95 | 18 | 0 | 180 |
| | 5 | 15 | 0.07 | 0.02 | 31 | 100 | 18 | 0 | 240 |
| | 6 | 48 | 0.83 | 0.71 | 85 | 98 | 28 | 0 | 110 |
| | 7 | 35 | 0.50 | 0.48 | 95 | 100 | 18 | 0 | 130 |
| | 8 | 16 | 0.07 | 0.01 | 21 | 82 | 25 | 0 | 160 |
| | 9 | 26 | 0.60 | 0.37 | 62 | 95 | 29 | 0 | 170 |
| | 10 | 22 | 0.07 | 0.03 | 38 | 100 | 14 | 0 | 270 |
| | 11 | 38 | 1.48 | 0.96 | 65 | 100 | 35 | 0 | 100 |
| | 12 | 29 | 0.80 | 0.44 | 55 | 97 | 38 | 0 | 150 |
| | 13 | 22 | 0.27 | 0.12 | 45 | 98 | 16 | 0 | 140 |
| | 14 | 28 | 0.20 | 0.08 | 38 | 92 | 19 | 0 | 180 |
| | 15 | 32 | 0.40 | 0.31 | 77 | 85 | 19 | 0 | 180 |
| | 16 | 25 | 0.13 | 0.05 | 34 | 94 | 16 | 0 | 230 |
| | 17 | 29 | 0.10 | 0.04 | 40 | 88 | 18 | 0 | 150 |
| | 18 | 21 | 0.10 | 0.03 | 32 | 93 | 20 | 0 | 190 |

*1 Number density of inviscid inclusions. Mean number in all fields of vision (pieces/$mm^2$)
*2 Number density of inviscid inclusions conforming to composition A. Mean number in all fields of vision (pieces/$mm^2$)
*3 Rate of inviscid inclusions conforming to composition A and rate of those conforming to composition A or B to all inviscid inclusions.
*4 Max d of inviscid inclusions conforming to composition A.

TABLE 2

| | No. | Average composition of non-metallic inclusions (wt %)*5 | | | | | | | Composition A: average composition of inclusions (wt %)*6 | | | | | | |
|---|---|---|---|---|---|---|---|---|---|---|---|---|---|---|---|
| | | $SiO_2$ | MnO | $Al_2O_3$ | MgO | CaO | $TiO_2$ | Others | $SiO_2$ | MnO | $Al_2O_3$ | MgO | CaO | $TiO_2$ | Others |
| Invented materials | 1 | 59.1 | 9.3 | 11.5 | 5.9 | 13.2 | 1.0 | 0.0 | 76 | 8 | 5 | 2 | 8 | 1 | 0 |
| | 2 | 58.8 | 5.9 | 14.6 | 4.2 | 13.9 | 2.0 | 0.7 | 94 | 1 | 2 | 0 | 1 | 2 | 0 |
| | 3 | 70.2 | 8.5 | 11.0 | 5.4 | 3.5 | 1.4 | 0.0 | 92 | 2 | 1 | 3 | 0 | 2 | 0 |
| | 4 | 64.1 | 8.2 | 14.1 | 2.6 | 7.8 | 0.4 | 2.9 | 89 | 1 | 3 | 1 | 2 | 1 | 3 |
| | 5 | 39.6 | 6.1 | 26.6 | 4.4 | 12.8 | 3.8 | 6.8 | 72 | 2 | 8 | 3 | 10 | 1 | 4 |
| | 6 | 89.8 | 2.3 | 3.1 | 1.8 | 2.9 | 0.0 | 0.1 | 95 | 1 | 2 | 1 | 1 | 0 | 0 |
| | 7 | 83.6 | 12.9 | 1.2 | 1.2 | 0.2 | 1.0 | 0.1 | 85 | 12 | 1 | 1 | 0 | 1 | 0 |
| | 8 | 51.6 | 6.3 | 11.7 | 4.5 | 23.9 | 0.6 | 1.4 | 78 | 1 | 15 | 1 | 4 | 0 | 1 |

TABLE 2-continued

| | | | | | | | | | | | | | | |
|---|---|---|---|---|---|---|---|---|---|---|---|---|---|---|
| 9 | 71.5 | 10.8 | 4.5 | 4.3 | 7.0 | 1.0 | 1.0 | 82 | 11 | 3 | 0 | 2 | 1 | 1 |
| 10 | 56.7 | 23.7 | 2.2 | 5.7 | 7.6 | 3.4 | 0.6 | 71 | 20 | 1 | 2 | 2 | 4 | 0 |
| 11 | 83.1 | 2.5 | 4.9 | 1.8 | 4.8 | 2.1 | 1.0 | 96 | 0 | 1 | 0 | 2 | 0 | 1 |
| 12 | 70.6 | 3.8 | 2.4 | 12.2 | 8.4 | 0.6 | 2.2 | 92 | 3 | 2 | 0 | 1 | 1 | 1 |
| 13 | 62.0 | 5.0 | 14.2 | 3.8 | 12.1 | 1.1 | 1.9 | 85 | 4 | 2 | 6 | 0 | 0 | 3 |
| 14 | 69.8 | 5.4 | 4.3 | 9.4 | 8.3 | 0.5 | 2.2 | 95 | 0 | 0 | 2 | 0 | 0 | 3 |
| 15 | 84.1 | 0.3 | 2.7 | 0.5 | 7.8 | 0.5 | 4.1 | 93 | 0 | 2 | 0 | 0 | 0 | 5 |
| 16 | 60.3 | 8.1 | 14.5 | 2.4 | 11.7 | 0.9 | 2.0 | 91 | 1 | 2 | 0 | 1 | 1 | 4 |
| 17 | 69.0 | 5.1 | 9.0 | 2.9 | 10.8 | 0.5 | 2.7 | 95 | 2 | 1 | 0 | 0 | 0 | 2 |
| 18 | 67.0 | 3.4 | 4.0 | 8.6 | 15.7 | 0.3 | 0.9 | 88 | 1 | 5 | 2 | 2 | 1 | 1 |

| | | Composition B: average composition of inclusions (wt %)*7 | | | | | | |
|---|---|---|---|---|---|---|---|---|
| | No. | $SiO_2$ | MnO | $Al_2O_3$ | MgO | CaO | $TiO_2$ | Others |
| Invented materials | 1 | 50 | 10 | 15 | 8 | 16 | 1 | 0 |
| | 2 | 45 | 8 | 20 | 6 | 18 | 2 | 1 |
| | 3 | 55 | 13 | 18 | 7 | 6 | 1 | 0 |
| | 4 | 48 | 14 | 23 | 4 | 8 | 0 | 3 |
| | 5 | 25 | 8 | 35 | 5 | 14 | 5 | 8 |
| | 6 | 62 | 11 | 11 | 7 | 8 | 0 | 1 |
| | 7 | 57 | 30 | 4 | 5 | 3 | 0 | 1 |
| | 8 | 43 | 10 | 14 | 7 | 23 | 1 | 2 |
| | 9 | 55 | 12 | 8 | 13 | 10 | 1 | 1 |
| | 10 | 48 | 26 | 3 | 8 | 11 | 3 | 1 |
| | 11 | 59 | 7 | 12 | 5 | 10 | 6 | 1 |
| | 12 | 44 | 5 | 3 | 29 | 15 | 0 | 4 |
| | 13 | 43 | 6 | 25 | 2 | 21 | 2 | 1 |
| | 14 | 55 | 10 | 8 | 16 | 8 | 1 | 2 |
| | 15 | 62 | 4 | 15 | 6 | 4 | 6 | 3 |
| | 16 | 44 | 13 | 23 | 4 | 14 | 1 | 1 |
| | 17 | 52 | 9 | 18 | 6 | 10 | 1 | 4 |
| | 18 | 58 | 5 | 4 | 13 | 19 | 0 | 1 |

*5 Average composition of all inviscid inclusions in field of observation.
*6 Average composition of inviscid inclusions conforming to composition A among all inviscid inclusions in field of observation.
*7 Average composition of inviscid inclusions conforming to composition B among all inviscid inclusions in field of observation.

TABLE 3

| | | Chemical composition (wt %) | | | | | | | | | | | | | |
|---|---|---|---|---|---|---|---|---|---|---|---|---|---|---|---|
| | No. | C | Si | Mn | P | S | Cr | Ni | Cu | B | Ti | V | Nb | Mo | Co |
| Comparative materials | 19 | 0.81 | 0.25 | 0.55 | 0.010 | 0.015 | — | — | — | — | — | — | — | — | — |
| | 20 | 0.72 | 0.20 | 0.50 | 0.025 | 0.023 | — | — | — | — | — | — | — | — | — |
| | 21 | 0.82 | 0.09 | 0.50 | 0.013 | 0.021 | — | — | — | — | — | — | — | — | — |
| | 22 | 0.62 | 0.19 | 0.11 | 0.012 | 0.016 | — | — | — | — | — | — | — | — | — |
| | 23 | 0.75 | 1.52 | 0.80 | 0.009 | 0.018 | — | — | — | — | — | — | — | — | — |
| | 24 | 0.82 | 0.19 | 1.53 | 0.011 | 0.023 | — | — | — | — | — | — | — | — | — |
| | 25 | 0.73 | 0.34 | 0.49 | 0.022 | 0.024 | — | — | — | — | — | — | — | — | — |
| | 26 | 0.75 | 0.19 | 0.48 | 0.009 | 0.024 | — | — | — | — | — | — | — | — | — |

| | No. | ppm Total oxygen content | Number of total inclusions *1 | Number of inclusions of composition A *2 | Rate of inclusions (%) *3 A | Rate of inclusions (%) *3 A + B | Max. d (μm) *4 | Wire disconnection index | Die service life index |
|---|---|---|---|---|---|---|---|---|---|
| Comparative materials | 19 | 14 | 0.25 | 0.01 | 5 | 51 | 35 | 41 | 70 |
| | 20 | 55 | 0.58 | 0.56 | 96 | 100 | 24 | 0 | 10 |
| | 21 | 18 | 0.33 | 0.02 | 5 | 42 | 38 | 25 | 80 |
| | 22 | 28 | 0.37 | 0.03 | 8 | 35 | 34 | 10 | 60 |
| | 23 | 19 | 0.42 | 0.39 | 94 | 94 | 51 | 10 | 130 |
| | 24 | 28 | 0.17 | 0.04 | 23 | 38 | 36 | 15 | 130 |

TABLE 3-continued

| | | | | | | | | | |
|---|---|---|---|---|---|---|---|---|---|
| | 25 | 38 | 1.55 | 1.24 | 80 | 96 | 26 | 10 | 10 |
| | 26 | 45 | 0.47 | 0.46 | 98 | 100 | 42 | 15 | 20 |

*1 Number density of inviscid inclusions. Mean number in all fields of vision (pieces/$mm^2$)
*2 Number density of inviscid inclusions conforming to composition A. Mean number in all fields of vision (pieces/$mm^2$)
*3 Rate of inviscid inclusions conforming to composition A and rate of those conforming to composition A or B to all inviscid inclusions.
*4 Max d of inviscid inclusions conforming to composition A.

TABLE 4

| | | Average composition of non-metallic inclusions (wt %)*5 | | | | | | | Composition A: average composition of inclusions (wt %)*6 | | | | | | |
|---|---|---|---|---|---|---|---|---|---|---|---|---|---|---|---|
| | No. | $SiO_2$ | MnO | $Al_2O_3$ | MgO | CaO | $TiO_2$ | Others | $SiO_2$ | MnO | $Al_2O_3$ | MgO | CaO | $TiO_2$ | Others |
| Comparative materials | 19 | 26.3 | 4.7 | 34.3 | 16.3 | 13.0 | 2.0 | 3.5 | 71 | 1 | 10 | 3 | 10 | 2 | 3 |
| | 20 | 94.8 | 0.8 | 1.2 | 0.0 | 3.0 | 0.2 | 0.0 | 96 | 0 | 1 | 0 | 3 | 0 | 0 |
| | 21 | 33.4 | 4.6 | 38.2 | 8.4 | 14.8 | 0.4 | 0.3 | 73 | 2 | 5 | 4 | 11 | 0 | 5 |
| | 22 | 52.1 | 2.2 | 32.2 | 2.8 | 8.2 | 1.4 | 1.2 | 93 | 0 | 1 | 0 | 4 | 2 | 0 |
| | 23 | 95.1 | 0.9 | 0.0 | 0.0 | 3.9 | 0.0 | 0.0 | 98 | 1 | 0 | 0 | 1 | 0 | 0 |
| | 24 | 56.5 | 36.3 | 2.4 | 2.0 | 2.5 | 0.2 | 0.2 | 95 | 4 | 0 | 0 | 1 | 0 | 0 |
| | 25 | 84.1 | 1.3 | 2.9 | 1.6 | 5.2 | 3.8 | 1.1 | 93 | 0 | 1 | 1 | 0 | 4 | 1 |
| | 26 | 89.5 | 5.1 | 2.1 | 0.2 | 2.1 | 0.0 | 2.1 | 89 | 5 | 2 | 0 | 2 | 0 | 2 |

| | | Composition B: average composition of inclusions (wt %)*7 | | | | | | | Inclusions of other |
|---|---|---|---|---|---|---|---|---|---|
| | No. | $SiO_2$ | MnO | $Al_2O_3$ | MgO | CaO | $TiO_2$ | Others | compositions |
| Comparative materials | 19 | 25 | 8 | 33 | 2 | 25 | 3 | 4 | $Al_2O_3$ or MgO type inclusions |
| | 20 | 65 | 21 | 5 | 1 | 3 | 4 | 1 | |
| | 21 | 38 | 9 | 32 | 5 | 15 | 1 | 0 | $Al_2O_3$ type inclusions |
| | 22 | 45 | 8 | 30 | 8 | 5 | 2 | 2 | $Al_2O_3$ type inclusions |
| | 23 | — | — | — | — | — | — | — | |
| | 24 | 45 | 29 | 8 | 9 | 7 | 1 | 1 | $SiO_2$—MnO inclusions |
| | 25 | 48 | 8 | 13 | 5 | 20 | 4 | 2 | |
| | 26 | 63 | 10 | 6 | 8 | 8 | 0 | 5 | |

*5 Average composition of all inviscid inclusions in field of observation.
*6 Average composition of inviscid inclusions conforming to composition A among all inviscid inclusions in field of observation.
*7 Average composition of inviscid inclusions conforming to composition B among all inviscid inclusions in field of observation.

All the materials according to the present invention, Nos. 1 to 18 shown in Tables 1 and 2, demonstrated good results.

The examination results of the comparative materials shown in Tables 3 and 4 are described hereafter. No. 19 is a case that the oxygen content is lower than the range according to the present invention. Due to strong deoxidation, hard inclusions comprising high concentrations of $Al_2O_3$ and MgO are formed and, as a consequence, the wire disconnection index is high. No. 20 is a case that the oxygen content is higher than the range according to the present invention. Here the number of inclusions is large and the die service life is poor. In Nos. 21 and 22, the contents of Si and Mn, respectively, are lower than the ranges according to the present invention. In either case, the rate of the inclusions having high $Al_2O_3$ concentration (not falling within the composition A or B) exceeds 20%, and the wire disconnection index is high. In No. 23, the content of Si is higher than the range according to the present invention, and, as a result of the formation of inclusions consisting only of $SiO_2$ during deoxidation and those of large sizes, the wire disconnection index is high. In No. 24, Mn content is higher than the range according to the present invention, and, the rate of $SiO_2$-MnO binary inclusions is high due to too strong an effect of Si-Mn compound deoxidation, resulting in a high wire disconnection index. In No. 25, the number of inclusions is too large due to insufficient inclusion removal during the refining processes, resulting in somewhat higher wire disconnection index in addition to a poor die service life. No. 26 is a case that the maximum diameter of inviscid inclusions conforming to composition A is larger than the range according to the present invention, and, the wire disconnection index is high.

The fatigue resistance was evaluated regarding the materials according to the present invention and the comparative materials. Material No. 2 according to the present invention shown in Tables 1 and 2 and comparative material No. 19 shown in Tables 3 and 4 were hot rolled into steel wires of 5.5 mm in diameter, drawn into a diameter of 1.6 mm, heat-treated at 950° C. to form γ grains, and then immersed in a lead bath at 560° C. for final patenting, to make steel wires having a pearlite structure. The wires thus obtained were then continuously drawn into a diameter of 0.3 mm, and the fatigue properties of the product wires were compared through Hunter fatigue testing. Table 5 shows results of tensile tests and Hunter fatigue tests of the 0.3-mm diameter wires.

As shown in Table 5, there is no difference of tensile strength between material No. 2 according to the present invention and material No. 19 for comparison. In contrast, with regard to fatigue limit stress based on the Hunter fatigue tests, material No. 2 according to the present invention showed a higher fatigue limit stress than material No. 19 for comparison, as seen in the same table.

TABLE 5

| | | Tensile test results | | | Fatigue test result |
|---|---|---|---|---|---|
| | No. | Diameter (mm) | Tensile strength MPa | Reduction of area (%) | Fatigue limit stress/Tensile strength |
| Invented material | 2 | 0.302 | 3425 | 39.8 | 0.291 |
| Comparative material | 23 | 0.301 | 3483 | 38.6 | 0.253 |

INDUSTRIAL APPLICABILITY

A high carbon steel wire according to the present invention can be manufactured at a reduced cost due to reduced use of costly alloys and maintains the same excellent wire-drawability and fatigue resistance after wire drawing as conventionally enjoyed.

What is claimed is:

1. A high carbon steel wire excellent in wire-drawability and fatigue resistance after wire drawing, characterized in that; the total oxygen content is 15 to 50 ppm; among non-metallic inclusions included therein, the number of inviscid inclusions is 1.5 pieces/$mm^2$ or less in average Under the visual field of an optical microscope; among the inviscid inclusions, the number of those having a composition falling within composition A specified below accounts for more than 20% and the total number of those having a composition falling within composition A or B specified below accounts for 80% or more; and the thickness of the inviscid inclusions having a composition falling within composition A specified below is 40 $\mu$m or less;

composition A: containing over 70% of $SiO_2$, composition B: containing 25 to 70% of $SiO_2$, 8 to 30% of MnO, 40% or less of MgO, 35% or less of $Al_2O_3$, 25% or less of CaO and 6% or less of $TiO_2$, and at $^3$least 5% of one or both of $Al_2O_3$ and MgO, and additionally at least 2% of one or both of CaO and $TiO_2$.

2. A high carbon steel wire excellent in wire-drawability and fatigue resistance after wire drawing according to claim 1, characterized in that the inclusions having composition B specified above contain 5% or less of other oxides (one or more of the oxides of V, Ba, Zr and Na and trace amount of other oxides inevitably included, hereunder referred to as "other oxides").

3. A high carbon steel wire excellent in wire-drawability and fatigue resistance after wire drawing according to claim 1, characterized in that the number of inviscid inclusions having a composition falling within composition A is 1 piece/$mm^2$ or less in an observation visual field.

4. A high carbon steel wire excellent in wire-drawability and fatigue resistance after wire drawing according to claim 1, characterized by containing 0.4 to 1.2% of C, 0.1 to 1.5% of Si and 0.1 to 1.5% of Mn in weight.

5. A high carbon steel wire excellent in wire-drawability and fatigue resistance after wire drawing according to claim 1, characterized by containing, in weight, 0.4 to 1.2% of C, 0.1 to 1.5% of Si and 0.1 to 1.5% of Mn, additionally P and S controlled not to exceed 0.02%, respectively, and one or more of 0.05 to 1.0% of Cr, 0.05 to 1.0% of Ni, 0.05 to 1.0% of Cu, 0.001 to 0.01% of B, 0.001 to 0.2% of Ti, 0.001 to 0.2% of V, 0.001 to 0.2% of Nb, 0.05 to 1.0% of Mo and 0.1 to 2% of Co.

* * * * *